US005607335A

United States Patent [19]

Spindt et al.

[11] Patent Number: 5,607,335

[45] Date of Patent: Mar. 4, 1997

[54] FABRICATION OF ELECTRON-EMITTING STRUCTURES USING CHARGED-PARTICLE TRACKS AND REMOVAL OF EMITTER MATERIAL

[75] Inventors: Christopher J. Spindt, Menlo Park; John M. Macaulay, Palo Alto, both of Calif.

[73] Assignee: Silicon Video Corporation, San Jose, Calif.

[21] Appl. No.: 269,311

[22] Filed: Jun. 29, 1994

[51] Int. Cl.[6] ..... H01J 9/02

[52] U.S. Cl. ..... 445/50; 313/309

[58] Field of Search ..... 445/50, 309, 336

[56] References Cited

U.S. PATENT DOCUMENTS

| | | | |
|---|---|---|---|
| 3,303,085 | 2/1967 | Price et al. | 428/131 |
| 3,755,704 | 8/1973 | Spindt et al. | 313/309 |
| 3,970,887 | 7/1976 | Smith et al. | 313/309 |
| 3,998,678 | 12/1976 | Fukase et al. | 156/651 |
| 4,008,412 | 2/1977 | Yuito et al. | 313/309 |
| 4,874,981 | 10/1989 | Spindt | 313/309 |
| 4,940,916 | 7/1990 | Borel et al. | 313/306 |
| 5,053,673 | 10/1991 | Tomii et al. | 313/308 |
| 5,150,019 | 9/1992 | Thomas et al. | 313/309 X |
| 5,194,780 | 3/1993 | Meyer | 313/309 |
| 5,199,917 | 4/1993 | MacDonald et al. | 445/50 X |
| 5,228,877 | 7/1993 | Allaway et al. | 445/24 |
| 5,277,638 | 1/1994 | Lee | 445/50 X |
| 5,316,511 | 5/1994 | Lee | 445/50 X |

FOREIGN PATENT DOCUMENTS

508737A1 8/1992 European Pat. Off. .

OTHER PUBLICATIONS

Busta, "Vacuum microelectronics—1992," *J. Micromech. Microeng.*, vol. 2, 1992, pp. 43–74.

Fisher et al, "Production and use of nuclear tracks: imprinting structure on solids," *Rev. Mod. Phys.*, Oct. 1983, pp. 907–948.

Betsui, "Fabrication and Characteristics of Si Field Emitter Arrays," *Tech. Dig. IVMC 91*, 1991, pp. 26–29.

Chakarvarti et al, "Morphology of etched pores and microstructures fabricated from nuclear track filters," *Nucl. Instr. & Meth. Phys. Res.*, vol. B62, 1991, pp. 209–115.

Chakarvarti et al, "Microfabrication of metal–semiconductor heterostructures and tubules using nuclear track filters," *Micromech. Microeng.*, vol. 3, 1993, pp. 57–59.

Huang et al, "200–nm Gated Field Emitters," *IEEE Elec. Dev. Ltrs.*, vol. 14, Mar. 1993, pp. 121–122.

Bozler et al, "Arrays of Gated Field–emitter Cones Having 0.32–μm Tip–To–Tip Spacings", *IVMC 1993 Tech. Dig.*, 6th Int'l Vac. Microelectronic Conf., 12–15 Jul. 1993, pp. 8–9.

*Primary Examiner*—Kenneth J. Ramsey

*Attorney, Agent, or Firm*—Skjerven, Morrill, MacPherson, Franklin & Friel; Alan H. MacPherson; Ronald J. Meetin

[57] ABSTRACT

An electron emitter suitable for a flat-panel CRT display is fabricated by a process in which charged particles are passed through a track layer (144) to create charged-particle tracks (146$_1$). The track layer is etched along the tracks to form apertures (148$_1$) that are employed in defining corresponding cap regions (150A) over an underlying emitter layer (142). After removing the track layer, part of the emitter layer is removed using the cap regions as masks to control the extent of the emitter material removed. Electron-emissive elements (142D), typically in the shape of cones, are thereby formed in the remainder (142C) of the emitter layer. The electron emitter can also be provided with a gate electrode (158C).

24 Claims, 5 Drawing Sheets

FABRICATION OF ELECTRON-EMITTING STRUCTURES USING CHARGED-PARTICLE TRACKS AND REMOVAL OF EMITTER MATERIAL

FIELD OF USE

This invention relates to electron emission. More particularly, this invention relates to techniques for manufacturing electron-emitting structures, commonly referred to as cathodes, suitable for products such as cathode-ray tube ("CRT") displays of the flat-panel type.

BACKGROUND ART

Cathodes can emit electrons by photoemission, thermionic emission, and field emission, or as the result of negative electron affinity. A field-emission cathode (or field emitter) provides electrons when subjected to an electric field of sufficient strength. The electric field is created by applying a suitable voltage between the cathode and an electrode, typically referred to as the anode or gate electrode, situated a short distance away from the cathode.

When used in a flat-panel display such as a flat-panel television or video monitor, a field emitter typically contains a group, often a very large group, of individual electron-emissive elements distributed across a supporting structure. This configuration is referred to here as an area field emitter. Busta, "Vacuum microelectronics—1992," *J. Micromech. Microeng.*, Vol. 2, 1992, pp. 43–74, describes a number of different techniques that have been investigated for manufacturing electron-emissive elements in area field emitters.

Fischer et al, "Production and use of nuclear tracks: imprinting structure on solids," *Rev. Mod. Phys.*, October 1983, pp. 907–948, describes how nuclear tracks are employed in manufacturing field emitters according to a replica technique. In Fischer et al, nuclear tracks are formed through a substrate. The tracks are etched to create cavities in the substrate after which metal is deposited on the substrate to create a film that extends across the substrate and fills the cavities. The substrate is then removed. The metal film, including the resultant metal protrusions, form an area field emitter as a replica of the substrate.

Betsui, "Fabrication and Characteristics of Si Field Emitter Arrays," *Tech. Dig. IVMC* 91, 1991, pp. 26–29, and Fukuta et al, European Patent Publication 508,737 A1, describes similar processes for creating an array of generally conical field-emission elements from an emitter layer. In Betsui, the emitter layer consists of n-type silicon. The emitter layer in Fukuta et al consists of a metal having a high melting point. Tantalum, molybdenum, titanium, and niobium are cited as candidate metals.

In the processes of both Betsui and Fukuta et al, a silicon oxide layer is provided along the top of the emitter layer. A photolithographic etching technique is employed to pattern the oxide layer into circular regions. That is, a layer of photoresist is provided over the oxide layer, selected parts of the photoresist are exposed to patterning radiation (typically ultraviolet light) through a suitable reticle, the photoresist is developed to form a photoresist mask having circular photoresist areas at desired locations for the circular oxide regions, the exposed portion of the oxide is removed, and the remaining photoresist is removed.

Using the circular oxide regions as etch masks, an etch is performed to remove part of the thickness of the emitter layer at the exposed areas and to remove part of the laterally adjoining emitter material under the circular oxide regions so that the remaining emitter material below each oxide region includes an upper section generally in the shape of a truncated upward-pointing cone. An oxidation is performed on the so patterned emitter layer for a time sufficient to grow an emitter oxide layer—i.e., an oxide of the emitter material—of such a nature that the truncated emitter cones largely become true cones.

A further layer of silicon oxide is deposited on the circular oxide regions and on the emitter oxide situated to the sides of the circular oxide regions. A metal gate layer consisting of chromium is deposited on the further oxide layer. The circular oxide regions and the overlying portions of the further oxide and gate layers are lifted off with an etchant that removes the underlying portions of the emitter oxide. The emitter cones are thereby exposed through the resultant openings in the gate layer. Finally, the gate layer is patterned to complete fabrication of the area field emitter.

The conical emitters made by Betsui and Fukuta et al appear to have good emission characteristics. Advantageously, the openings through the gate layer are self-aligned to the emitter cones. The process of Betsui or Fukuta et al is relatively simple Ideally, the electron-emission current density at a given applied extraction voltage in an area field emitter of a flat-panel CRT is uniform (substantially the same) across the emitter array. In a real field emitter, the emission current density typically becomes more uniform across the array as the emitter packing density—i.e., the number of emitters per unit area—increases and, correspondingly, as the lateral area occupied by an individual emitter decreases.

Depth of field, sometimes referred to as depth of focus, is commonly employed in characterizing radiation-based patterning techniques such as photolithography. Briefly stated, the depth of field is the (maximum) distance, measured along the optic axis, across which an acceptable pattern can be obtained on a generally flat surface situated, generally orthogonal to the optic axis, at any point along that distance. The depth of field in photolithography is finite and, in particular, is relatively small compared to what would be desirable for efficient production-scale manufacturing of area electron emitters suitable for flat-panel CRT applications.

Consider an electron-emitting device in which the total area of the surface to be photolithographically patterned is several square centimeters or more. The The flatness of the surface being patterned, the presence of features on the surface, and the alignment of the surface in the photolithographic radiation-exposure equipment combined with the small photolithographic depth of field significantly limit the minimum lateral size of features photolithographically defined at the surface using a single radiation exposure.

Finer photolithographic patterns can be obtained by exposing small parts of the total area to the patterning radiation in separate expose-and-move steps. However, such an expose-and-move process is time-consuming and therefore expensive because it requires re-alignment and re-focus before each exposure.

The use of photolithography to define the circular oxide regions in the area field emitters of Betsui and Fukuta et al limits the individual lateral emitter area of their conical emitters to photolithographically achievable dimensions. For example, the base diameter of the emitters in Betsui and Fukuta et al seems to be approximately 1–3 μm. Inasmuch as the oxidation/lift-off steps in Betsui and Fukuta et al appear to produce high-quality emitters, it would be desirable to overcome the limitations that photolithography imposes on the lateral emitter area in order to be able to place a greater number of smaller conical emitters into a given overall area and thereby attain more uniform emission current density.

GENERAL DISCLOSURE OF THE INVENTION

The present invention employs charged-particle tracks and emitter etching to produce electron-emissive elements—generally referred to as emitters—which are typically conical in shape. The present emitters form an area electron-emitting device suitable for CRT applications such as flat-panel displays.

The charged-particle tracks determine the locations of the emitters and enable their lateral areas to be made quite small. The lateral area occupied by each emitter typically has a mean diameter of 0.2 μm. This is considerably smaller than that achievable with the photolithographically limited technique of Betsui or Fukuta et al.

One item contributing to the small lateral area typically occupied by an emitter in the invention is the fact that a charged-particle track constitutes a damaged zone whose mean diameter is typically on the nanometer scale. Furthermore, in contrast to photolithography where the depth of field is finite and, in fact, is relatively small, the depth of field is effectively infinite for charged-particle tracks. As a result, depth of field does not place any significant practical limitations on the minimum lateral emitter feature size attainable in the invention.

Creating and etching the charged-particle tracks is no more complex than using photolithography. Subsequent emitter etching enables the emitters to have conical shapes that yield good emission characteristics. The invention thus attains the advantages of Betsui and Fukuta et al but avoids their disadvantages.

Specifically, in accordance with the invention, charged particles are passed through a track layer situated over an electrically non-insulating emitter layer to form a multiplicity of charged-particle tracks through the track layer. The emitter layer is preferably formed with electrically conductive material such as metal or/and semiconductor material doped to a moderate-to-high level so as to be electrically conductive. Although the track layer typically consists of electrical insulator, the major requirements on the constituency of the track layer are simply that it be selectively etchable and capable of recording charged-particle tracks. The track layer is etched along the tracks to form corresponding apertures through the track layer.

The apertures are used to define cap regions over the emitter layer. Preferably, the cap regions are formed in the apertures. The track layer is then removed in such a way that the cap regions remain in place. Performing these two steps typically entails depositing a cap layer over the track layer and into the apertures after which the track layer and overlying material of the cap layer are removed. The remaining portions of the cap layer form the cap regions. Alternatively, an electrochemical process can be employed to selectively deposit the cap regions.

Next, selected material of the emitter layer, typically including part of the emitter material under the cap regions, is removed in such a way that individual emitters are defined in the remainder of the emitter layer at locations respectively corresponding to the cap regions. Each individual emitter is normally centered on—i.e., aligned to—the corresponding cap region. Preferably, the emitters are created as upward-pointing cones. The cap regions are also removed to expose the emitters.

The area field emitter of the invention is typically furnished with a patterned gate electrode that lies over, and is insulatingly spaced apart from, the emitter layer. Gate openings extend through the gate layer at locations respectively centered on the individual emitters. The gate layer is typically created in a self-aligned manner by (a) sequentially depositing suitable insulating and gate materials and (b) removing the gate and insulating materials over the cap regions. The remaining gate material forms at least part of the gate layer.

The small lateral size of the emitters fabricated according to the present invention provides a number of advantages. For example, operating voltages can be considerably lower than that achievable with otherwise equivalent emitters of the prior art. Importantly, the emitter packing density is determined by the charged-particle track density. Because the lateral emitter size is small, the charged-particle track density can be readily adjusted to provide a considerably increased emitter packing density. This produces a much more uniform emission current density across the field-emission device.

BRIEF DESCRIPTION OF THE DRAWINGS

FIGS. 7 and 8 are briefly described above.

Like reference symbols are employed in the drawings and in the description of the preferred embodiments to represent the same or very similar item or items.

DESCRIPTION OF THE PREFERRED EMBODIMENTS

Figure 1A:
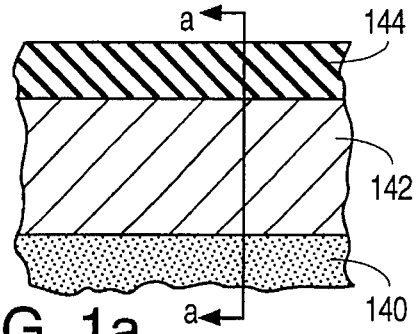
FIGS. 1*a*, 1*b*, 1*c*, 1*d*, 1*e*, 1*f*, 1*g*, and 1*h* are cross-sectional front views representing steps in manufacturing an area field emitter according to the invention.

Herein, the term "electrically insulating" (or "dielectric") generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/μm.

Examples of electrically conductive materials (or electrical conductors) are metals, metal-semiconductor compounds (such as metal silicides), and metal-semiconductor eutectics (such as gold-germanium). Electrically conductive materials also include semiconductors doped (n-type or p-type) to a moderate or high level. Electrically resistive materials include intrinsic and lightly doped (n-type or p-type) semiconductors. Further examples of electrically resistive materials are cermet (ceramic with embedded metal particles), other such metal-insulator composites, graphite, amorphous carbon, and modified (e.g., doped or laser-modified) diamond.

Referring to the drawings, FIGS. 1*a*–1*h* (collectively "FIG. 1") and FIGS. 2*a*–2*d* (collectively "FIG. 2") illustrate a process for manufacturing an area field-emission cathode structure using charged-particle tracks and emitter etching according to the teachings of the invention. The field-emission structure of FIGS. 1 and 2 is typically utilized to excite phosphors on a faceplate in a CRT of a flat-panel display such as a flat-panel television screen or a flat-panel video monitor suitable for a personal computer, a lap-top computer, or a work station.

The starting point for the fabrication process is a substrate 140 typically created from a plate having a largely flat upper surface and a largely flat lower surface (not shown) extending substantially parallel to the upper surface. See FIG. 1*a*. Substrate 140 normally consists, at least along its upper surface, of electrically resistive (intrinsic or lightly doped) semiconductor material or/and electrically insulating material. The resistive semiconductor material preferably is silicon of monocrystalline, multicrystalline, polycrystalline, or amorphous structure, but can be germanium or gallium arsenide. The insulating material is ceramic or/and glass.

An electrically non-insulating emitter layer 142 is provided along the top of substrate 140 as indicated in FIG. 1*a*. Emitter layer 142 preferably consists of an electrical conductor, specifically conductively doped (i.e., moderately or heavily doped) semiconductor material or/and metal. The conductively doped semiconductor material typically is n-type or p-type silicon of monocrystalline, multicrystalline, polycrystalline, or amorphous structure, but can be germanium or gallium arsenide. When substantially all of layer 142 is conductively doped silicon, the emitter thickness is 0.1–1 μm, typically 0.2 μm. For the case in which metal is used to form layer 142, the metal is typically titanium.

Emitter layer 142 is typically a patterned layer containing a group of parallel lines. When layer 142 is so configured, the final field-emission structure is particularly suitable for selectively exciting phosphors in a flat-panel CRT display. The emitter lines are normally no more than 300 μm wide for a 25-cm (diagonal) flat-panel display.

Figure 3A:
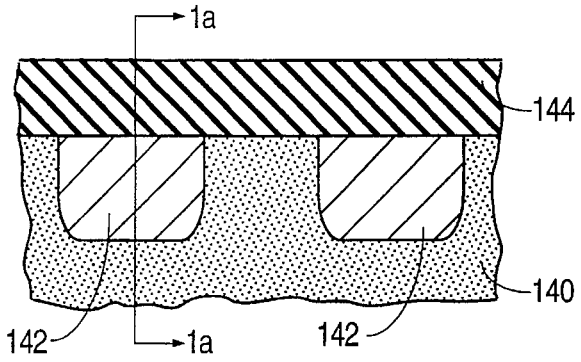
FIGS. 3*a*, 3*b*, and 7 are cross-sectional side views respectively corresponding to FIGS. 1*a*, 1*h*, and 5*d* for an embodiment in which the emitter lines are conductively doped regions formed in an electrically resistive semiconductor substrate. The cross sections of FIGS. 1*a*, 1*h*, and 5*d* are respectively taken through planes 1*a*—1*a*, 1*h*—1*h*, and 5*d*—5*d* in FIGS. 3*a*, 3*b*, and 7. The cross section of FIG. 3*a* is taken through plane a—a in FIG. 1*a*. The cross section of FIG. 3*b* is taken through stepped plane b—b in FIGS. 1*h* and 2*d*. The cross section of FIG. 7 is taken through stepped plane c—c in FIGS. 5*d* and 6.
Figure 4A:
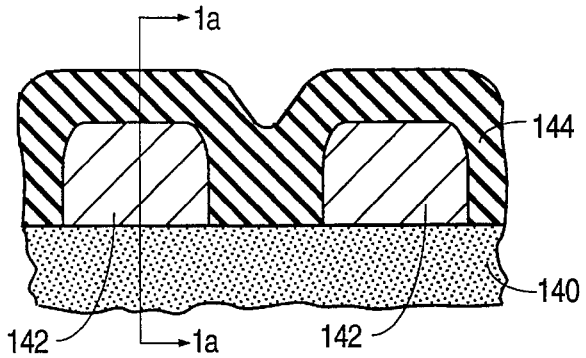
FIGS. 4*a*, 4*b*, and 8 are cross-sectional side views respectively corresponding to FIGS. 1*a*, 1*b*, and 5*d* for an embodiment in which the emitter lines consist of metal or conductively doped semiconductor material formed on an electrically insulating or resistive substrate. The cross sections of FIGS. 1*a*, 1*h*, and 5*d* are respectively taken through planes 1*a*—1*a*, 1*h*—1*h* and 5*d*—5*d* in FIGS. 4*a*, 4*b*, and 8. The cross section of FIG. 4*a* is taken through plane a—a in FIG. 1*a*. The cross section of FIG. 4*b* is taken through stepped plane b—b in FIGS. 1*h* and 2*d*. The cross section of FIG. 8 is taken through stepped plane c—c in FIGS. 5*d* and 6.

If substrate 140 consists of electrically resistive semiconductor material at least along the upper substrate surface, the emitter lines usually consist of conductively doped semiconductor material created by selectively introducing suitable dopant into the resistive semiconductor material. FIG. 3*a* depicts a vertical cross section through the structure of FIG. 1*a* for such an embodiment. FIG. 4*a* depicts a vertical cross section through the structure of FIG. 1*a* for an embodiment in which the emitter lines consist of metal or conductively doped semiconductor material formed on top of substrate 140.

Emitter layer 142 can be arranged in patterns other than parallel lines. In fact, layer 142 can even be unpatterned.

An electrically insulating track (or track-recording) layer 144 is formed on top of the structure. Parts of track layer 144 are situated on both substrate 140 and emitter layer 142. The thickness of layer 144 is 0.1–2 μm, typically 0.5 μm, depending on the desired diameter of apertures later formed through layer 144. Suitable materials for layer 144 fall into three groups: (a) organic polymers such as polycarbonate, polystyrene, and cellulose acetate (b) inorganic glasses such as phosphate, silicate, soda-lime, and spin-on glasses, and (c) crystals such as mica and quartz.

Figure 1B:
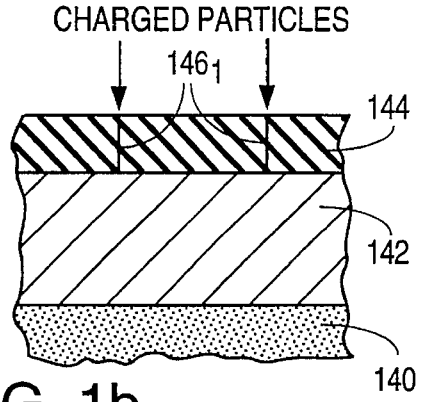
Figure 1C:
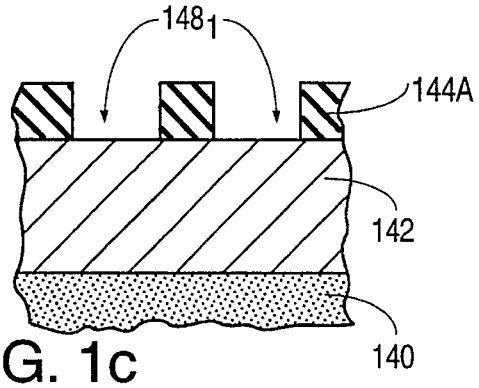
Figure 2A:
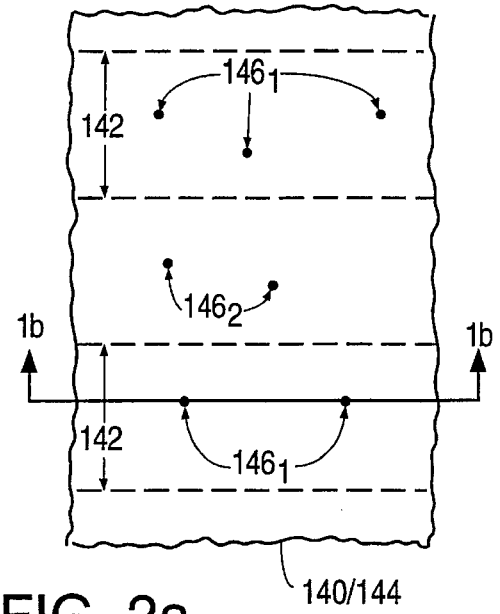
FIGS. 2*a*, 2*b*, 2*c*, and 2*d* are plan views respectively corresponding to FIGS. 1*b*, 1*c*, 1*f*, and 1*h*. The cross sections of FIGS. 1*b*, 1*c*, 1*f*, and 1*h* are respectively taken through planes 1*b*—1*b*, 1*c*—1*c*, 1*f*—1*f*, and 1*h*—1*h* in FIGS. 2*a*–2*d*.

The structure is subjected to energetic charged particles that impinge on top of track layer 144 in a direction largely perpendicular to the (unshown) flat lower surface of substrate 140 and thus in a direction generally perpendicular to the upper structural surface. The charged particles have sufficient energy to pass fully through layer 144 so as to form straight tracks through layer 144 at random locations across layer 144. FIGS. 1*b* and 2*a* illustrate the track formation. The charged-particle tracks constitute damaged zones along the particle paths. Each track has a heavily damaged core whose mean diameter is in the vicinity of 4 nm.

The charged-particle tracks are indicated by reference symbols beginning with "146" in FIGS. 1*b* and 2*a*. Although the charged particles also pass through emitter layer 142 (and typically into substrate 140), the charged particles do not significantly damage layer 142 and therefore do not create charged-particle tracks through layer 142. Two of the lines that typically form layer 142 are shown in dashed form in FIG. 2*a*. As indicated there, the tracks fall into two categories: (a) tracks $\mathbf{146}_1$ extending through portions of layer 144 overlying emitter layer 142 and (b) tracks $\mathbf{146}_2$ extending through portions of layer 144 situated directly on substrate 140 to the sides of layer 142.

Charged-particle tracks $\mathbf{146}_1$ and $\mathbf{146}_2$ (collectively "146") extend parallel to one another in a direction generally perpendicular to the upper structural surface. Although tracks 146 are randomly distributed across the field emitter, they have a well-defined average spacing. The track density is usually in the range of $10^6$–$10^9$ tracks/cm$^2$. A typical value falls in the narrower range of $10^7$–$10^8$ tracks/cm$^2$ which yields an average track spacing of approximately 1–3 μm. For illustrative purposes, only a small portion of tracks 146 is indicated in FIGS. 1*b* and 2*a*.

In a typical implementation, a charged-particle accelerator which forms a well-collimated beam of ions is employed to form tracks 146. The ion beam is scanned uniformly across track layer 144. The preferred-particle species is doubly ionized argon ($Ar^{++}$) at an energy of 8 MeV. Alternatively, tracks 146 could be created from a collimated source of nuclear fission particles produced, for example, by the radioactive element californium 252.

The damaged insulating material along tracks 146 is removed by bringing track layer 144 into contact with (e.g., by immersion) a suitable chemical etchant that attacks the damaged track material much more than the undamaged material of layer 144. As a result, generally circular pores are etched through layer 144 along tracks 146 down to emitter layer 142. The etchant preferably does not significantly attack any other parts of the field-emission structure.

The etch is continued into the largely undamaged material of track layer 144 to broaden the pores. Apertures $\mathbf{148}_1$ and $\mathbf{148}_2$ (collectively "148") are thereby respectively created along tracks $\mathbf{146}_1$ and $\mathbf{146}_2$. See FIGS. 1*c* and 2*b*. Apertures $\mathbf{148}_1$ expose corresponding portions of the upper surface of emitter layer 142.

Figure 2B:
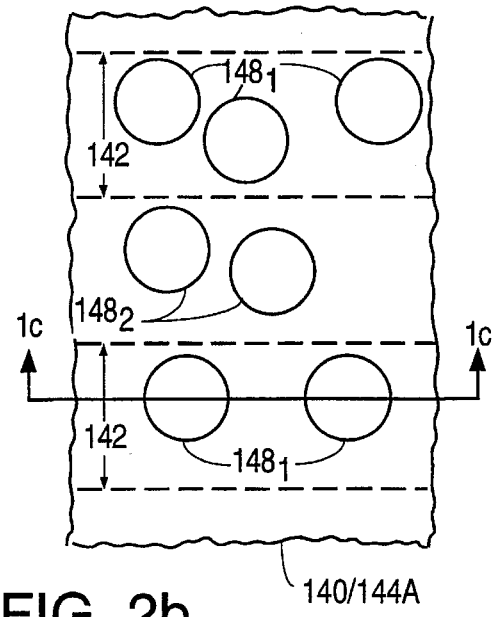

The full etch of track layer 144 is performed in a laterally uniform manner. Accordingly, each aperture 148 is generally circular in plan view as indicated in FIG. 2*b*. The thickness of layer 144 is reduced during the etch.

The second part of the insulating-material etch can be done with the etchant used during the first part or with another etchant. In either case, components 140 and 142 are not significantly attacked during the second part of the etch. When track layer 144 consists of a polymer, both parts of the etch are preferably done with sodium hydroxide or potassium hydroxide.

Apertures 148 reach an average diameter of 0.1–2 μm, typically 0.2 μm, along the bottom of the reduced-thickness remainder 144A of track layer 144. The aperture diameter is substantially the same for all of apertures 148. For illustrative purposes, the lateral dimensions of apertures 148 compared to the widths of the lines that form emitter layer 142 are greatly exaggerated in the plan-view drawings.

Apertures $\mathbf{148}_2$, which extend through portions of track layer 144A lying directly above substrate 140, do not significantly affect device operation. Accordingly, apertures $\mathbf{148}_2$ are not discussed further below or shown in any of the remaining drawings. In fact, the creation of apertures $\mathbf{148}_2$ could be avoided by using an appropriate mask during either the track-formation step or the aperture-etch step.

Figure 1D:
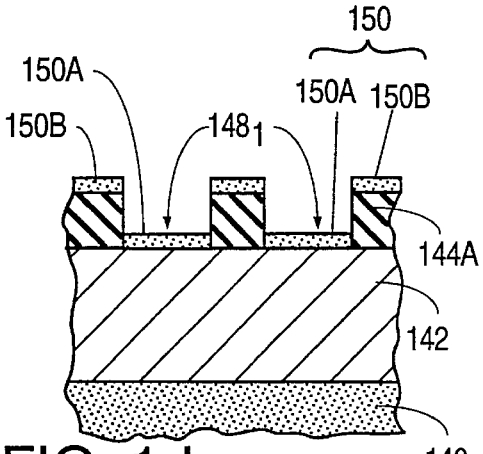

A cap layer 150 is deposited on top of the structure as shown in FIG. 1*d*. Cap layer 150 contains (a) main cap regions 150A situated on emitter layer 142 at the bottoms of apertures $\mathbf{148}_1$ and (b) a further cap region 150B situated on top of track layer 144A. Cap layer 150 may be formed with electrically insulating material or with electrically non-insulating material (or even with both types of material). For example, layer 150 typically consists of a metal such as chromium when emitter layer 142 is conductively doped silicon.

Cap layer 150 may be deposited by evaporating or sputtering the desired cap material. Alternatively, main cap regions 150A can be formed by a selective deposition technique such as electrochemical deposition (electroplating). In this case, substantially none of the cap material accumulates on track layer 144A—i.e., further cap region 150B is not formed.

The thickness of cap layer 150 is less than the thickness of track layer 144A. Specifically, the cap thickness is 0.05–1 μm, typically 0.2 μm. Although not shown in FIG. 1*d*, small pieces of the cap material may accumulate along the sidewalls of track layer 144A above main cap regions 150A. To the extent that such sidewall cap pieces are formed and not removed during the track-material dissolving operation described below, these sidewall cap pieces are removed according to a conventional technique that may slightly reduce the thickness of regions 150A and 150B.

The structure is subjected to an agent that dissolves track layer 144A but does not significantly affect cap layer 150 or any of the other structural components. All of layer 144A is removed during the etch. Further cap region 150B (when present) is lifted off during the removal of layer 144A to produce the structure shown in FIG. 1*e*. When layer 144A consists of a polymer such as polycarbonate, the dissolving step is performed with chloroform. A dilute hydrofluoric acid solution is used as the dissolving agent when layer 144A is glass.

Next, the structure is etched with an etchant that attacks emitter layer 142 but does not significantly attack cap regions 150A. The emitter etch is performed in such a way as to uniformly remove (a) emitter material not covered by cap regions 150A and (b) laterally adjacent emitter material extending partway under regions 150A, thereby creating a depression 152 in layer 142. See FIGS. 1*f* and 2*c*. Regions 150A act as etch masks to control the lateral extent of the etch. The etchant preferably is a reactive-ion etchant.

The emitter etch is conducted for a time sufficiently long to underetch a large fraction of lower surface of each cap region 150A but not long enough for depression 152 to reach substrate 140 or for the tops of the sidewalls of depression 152 to form points below regions 150A. As a result, regions 150A remain in place. Item 142A in FIG. 1*f* is the remainder of emitter layer 142. Along the upper surface of remaining emitter layer 142A, depression 152 defines truncated generally conical emitter portions 142B in layer 142A. Because the etch is done uniformly, each emitter portion 142B is centered on, and thereby aligned to, overlying cap region 150A.

Emitter portions 142B are sharpened by reacting emitter material along the upper surface of layer 142A with one or more other materials to form a layer 154 consisting of a compound of these materials. FIG. 1*g* shows the resultant structure. Item 142C is the remainder of emitter layer 142A. The reaction process consumes an amount of emitter material sufficient to enable generally conical electron-emissive portions 142D to be defined in the emitter material along the upper surface of layer 142C. Each emitter portion 142D has a sharply pointed tip directed towards a corresponding one of cap regions 150A.

Emitter portions 142D are generally cones even though their side surfaces are concave as viewed from the side. Each electron-emissive cone 142D is centered on overlying cap region 150A. Cones 142D have an average height of 0.1–2 μm, typically 0.2 μm. The base diameter of cones 142 is approximately the same as that of cap regions 150A and, accordingly, approximately the same as that of apertures $\mathbf{148}_1$. That is, cones 142D have an average base diameter of 0.1–2 μm, typically 0.2 μm.

Compound layer 154 is preferably an oxide of the emitter material. The emitter oxide is typically created by exposing the structure to an oxygen-containing gas, such as wet or dry oxygen, at high temperature. When emitter layer 142C is conductively doped silicon, layer 154 is silicon oxide. Likewise, layer 154 is a metal oxide when layer 142C is metal.

Compound layer 154 is removed with a suitable etchant. During the removal of layer 154, cap regions 150A are lifted off to produce the final field-emission structure shown in FIGS. 1*h* and 2*d*. A buffered hydrofluoric acid solution can be employed to remove layer 154 when it consists of silicon oxide. Emitter cones 142D are now electron-emissive elements which, in combination with the underlying structural components, form an area field emitter.

Figure 1E:
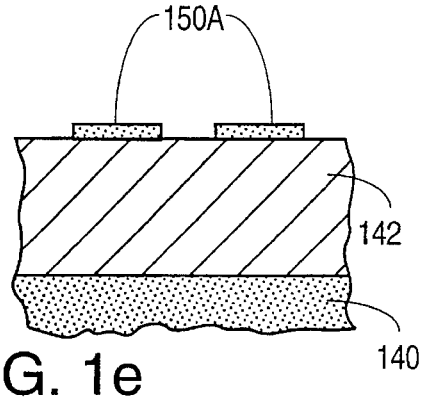
Figure 1F:
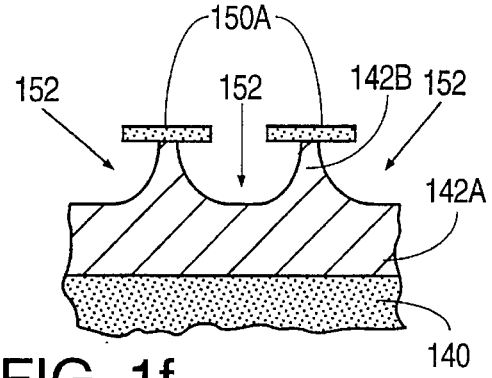
Figure 1G:
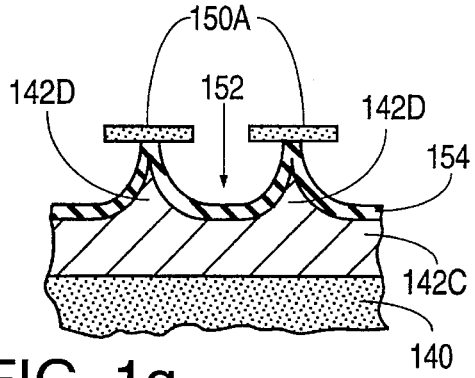
Figure 1H:
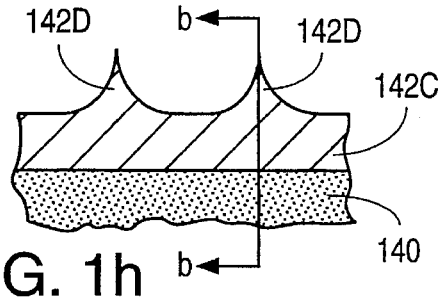
Figure 2C:
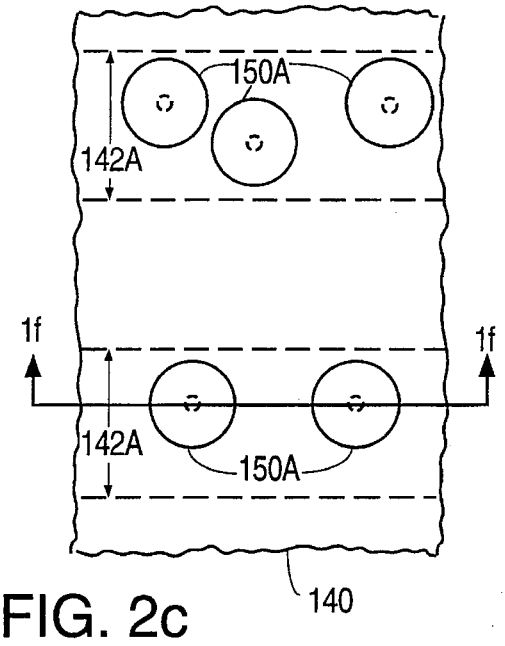
Figure 2D:
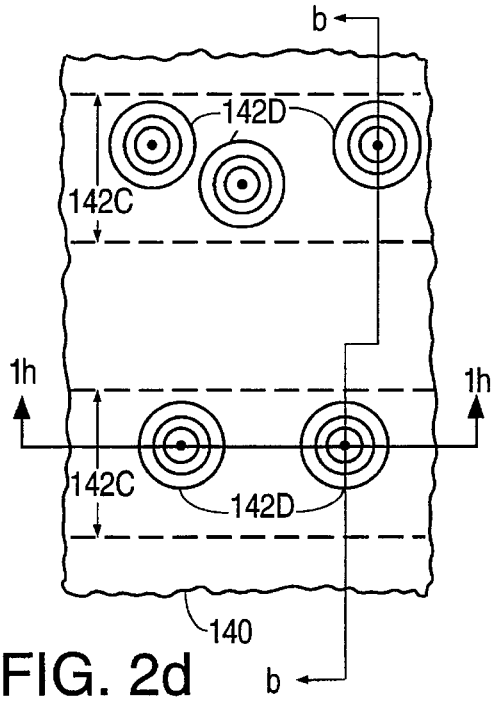
Figure 3B:
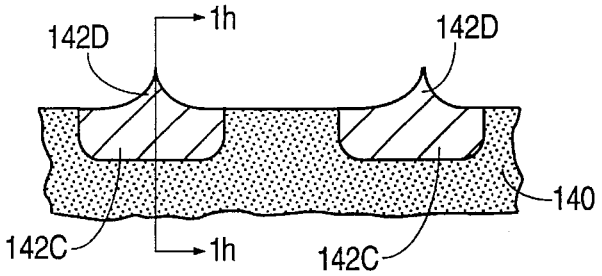
Figure 4B:
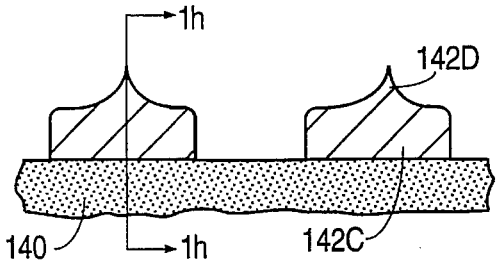

FIGS. 3*b* and 4*b* depict typical vertical cross sections through the final structure of FIGS. 1*h* and 2*d*. Analogous to FIG. 3*a*, FIG. 3*b* represents the embodiment in which emitter lines 142 are conductively doped semiconductor regions formed in electrically resistive semiconductor material. Analogous to FIG. 4*a*, FIG. 4*b* similarly represents the embodiment in which lines 142 consist of metal or conductively doped semiconductor material formed on substrate 140.

Figure 5A:
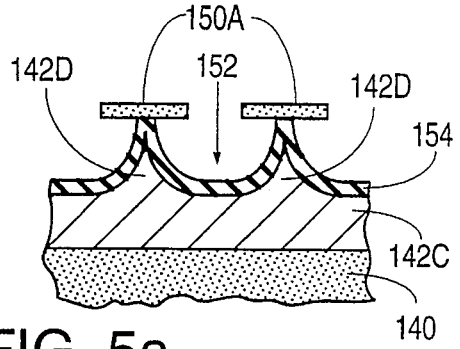
FIGS. 5*a*, 5*b*, 5*c*, and 5*d* are cross-sectional front views representing a set of steps alternatively performable on the structure of FIG. 1*g* for manufacturing a gated area field emitter according to the invention.
Figure 5B:
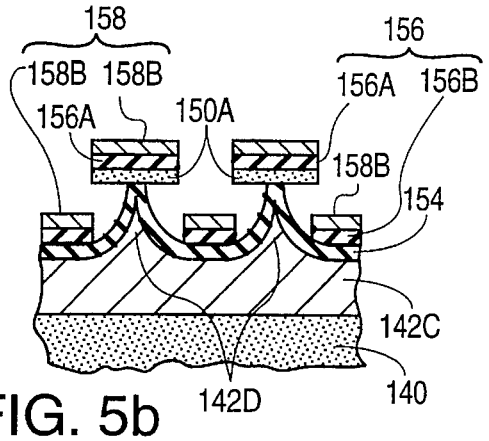
Figure 5C:
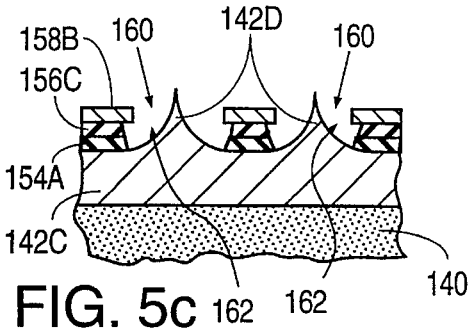
Figure 5D:
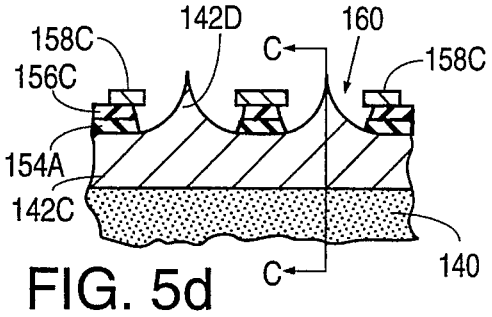
Figure 6:
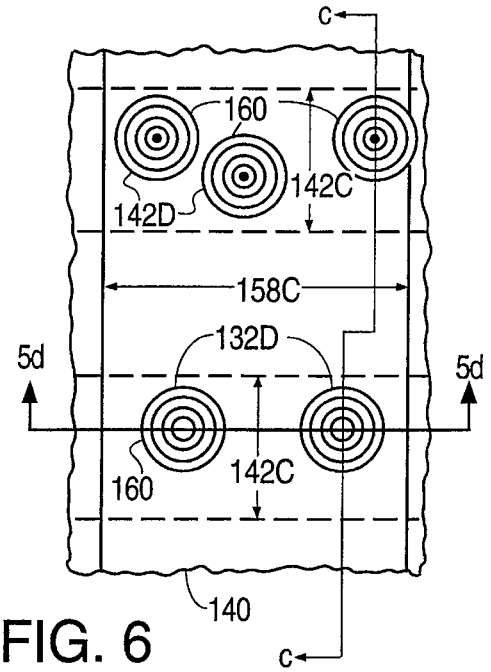
FIG. 6 is a plan view corresponding to FIG. 5*d*. The cross section of FIG. 5*d* is taken through plane 5*d*—5*d* in FIG. 6.

The processes of FIGS. 1 and 2 can be modified in a variety of ways. For example, a gate electrode can be provided. FIGS. 5*a*–5*d* (collectively "FIG. 5") and FIG. 6 illustrate how a gated area field emitter is created from the structure of FIG. 1*g* repeated here as FIG. 5*a*.

Electrically insulating material is deposited on the structure by causing the constituents of the insulating material to move towards the upper surface of the structure in a direction largely perpendicular to the lower structural surface. As shown in FIG. 5*b*, portions 156A of the insulating material accumulate on cap regions 150A. A portion 156B of the insulating material accumulates on the portion of compound layer 154 not covered (or not shadowed) by regions 150A. Insulating portions 156A and 156B together constitute a discontinuous insulating layer 156. The deposition of insulating layer 156 is typically performed by sputtering or chemical vapor deposition. Layer 156 typically consists of silicon oxide.

Next, electrically non-insulating gate material is similarly deposited on the upper surface of the structure in a direction generally perpendicular to the lower structural surface. As also shown in FIG. 5*b*, portions 158A and 158B of the gate material respectively accumulate on insulating portions 156A and 156B. Gate portions 158A and 158B together form a discontinuous gate layer 158. The deposition of gate layer 158 is typically performed by sputtering or evaporation. Layer 158 usually consists of an electrical insulator, typically a metal such as molybdenum. Layer 158 could also be formed with conductively doped semiconductor material such as n-type or p-type polycrystalline silicon. The composite thickness of insulating layer 156 and gate layer 158 is less than the height of emitter cones 142D.

Cap regions 150A are removed by subjecting the structure to an etchant that attacks the exposed material of compound layer 154 under cap regions 150A but does not significantly attack the gate material or emitter layer 142C. For example, a buffered hydrofluoric acid solution can again be employed when layer 154 consists of silicon oxide. The portions of layer 154 lying below cap regions 150A are thereby removed. As a result, regions 150A are lifted off along with overlying insulating portions 156A and gate portions 158A. The etching of layer 154 normally extends slightly under gate portions 156A. FIG. 5*c* depicts the resultant structure in which item 154A is the remainder of layer 154.

The etchant typically attacks the side edges of insulating portions 156B so as to slightly undercut remaining gate portion 158B. Item 156C in FIG. 5*c* is the remainder of portion 156B. Of course, layer 156B will remain fully in place to support gate portion 158B if the etchant does not attack layer 156B.

Remaining gate portion 158B forms a patterned gate layer. Emitter cones 142D preferably extend partially through gate openings 160 in patterned gate layer 158B. Because cap regions 150A were respectively centered on cones 142D, gate openings 160 are respectively centered on, and thus aligned to, cones 142D.

Remaining insulating portion 156C (or 156B) forms a patterned insulating layer through which dielectric openings 162 extend. If remaining compound portion 154A consists of insulating material, portion 154A forms part of this patterned insulating layer. As with gate openings 160, dielectric openings 162 are centered on cones 142D as the result of the self alignment that occurs during the fabrication process.

Using a suitable photoresist mask (not shown) gate layer 158B is patterned into a group of lines extending perpendicular to the lines that form emitter layer 142C. FIGS. 5*d* and 6 depict the final structure in which item 158C is the patterned remainder of gate layer 158B. FIG. 6 illustrates one of the lines that form patterned gate layer 158C. Again, cones 142D are electron-emissive elements.

Figure 7:
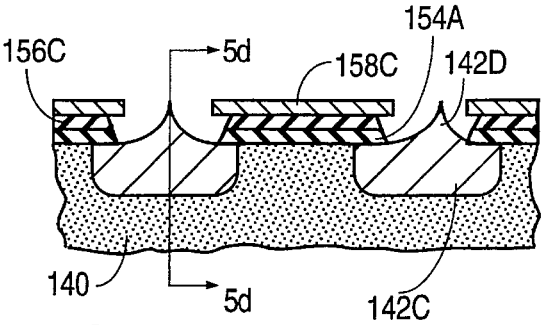
Figure 8:
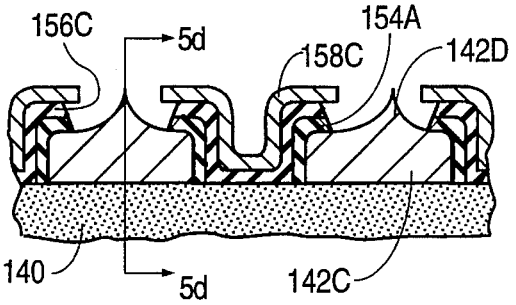

FIGS. 7 and 8 illustrate typical vertical cross sections through the final structure of FIGS. 5*d* and 6. FIG. 7 represents the embodiment where emitter lines 142 are conductively doped regions created in electrically resistive semiconductor material. FIG. 8 represents the embodiment where lines 142 consist of metal or conductively doped semiconductor material formed on substrate 140.

Figure 9A:
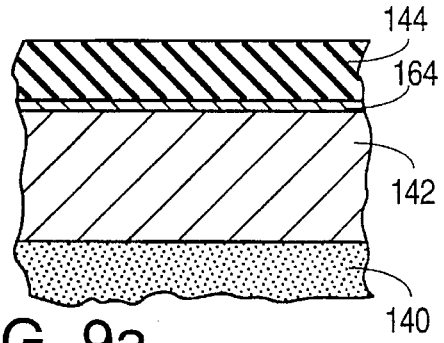
FIGS. 9*a*, 9*b*, 9*c*, 9*d*, 9*e*, and 9*f* are cross-sectional front views representing an alternative set of steps for achieving the structure of FIG. 1*e* in manufacturing an area field emitter according to the invention.
Figure 9D:
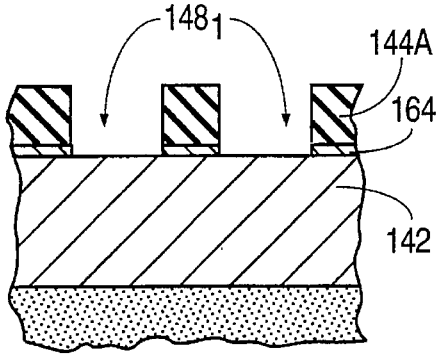

In some cases, it may be desirable to use an adhesion layer to prevent track layer 144 from peeling. Turning to FIGS. 9*a*–9*f* (collectively "FIG. 9"), they illustrate one example of how an adhesion layer 164 can be incorporated into the process of FIGS. 1 and 2. After emitter layer 142 is deposited on substrate 140, adhesion layer 164 is deposited on layer 142 as shown in FIG. 9*a*. Track layer 144 is then deposited on layer 164. A material that adheres well to both layers 142 and 144 is used for layer 164.

Figure 9B:
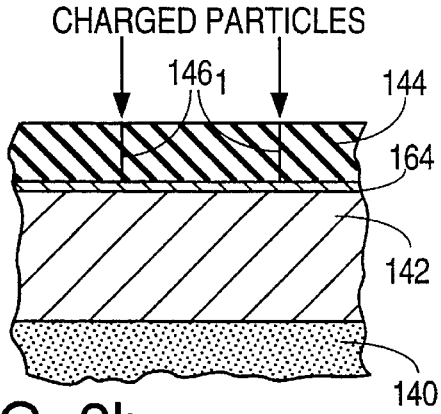

Charged-particle tracks $\mathbf{146}_1$ are formed through track layer 144 in the manner described above. FIG. 9*b* shows the structure at this point. Although not indicated in FIG. 9*b*, tracks $\mathbf{146}_1$ may extend through adhesion layer 164. Apertures $\mathbf{148}_1$ are then formed through layer 144 as indicated in FIG. 9*c*. Using remaining portions 144A of layer 144 as a mask, apertures $\mathbf{148}_1$ are extended through layer 164. See FIG. 9*d* in which item 164A is the remainder of layer 164.

Figure 9E:
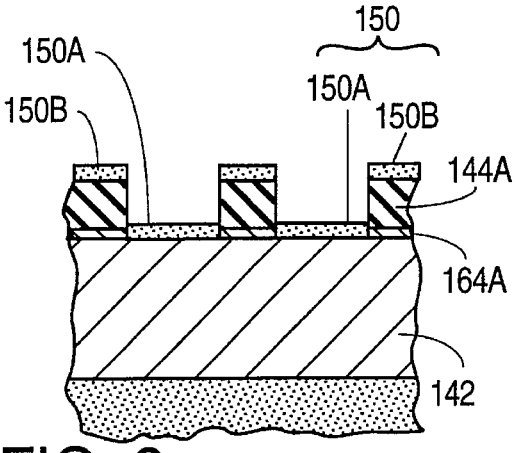
Figure 9C:
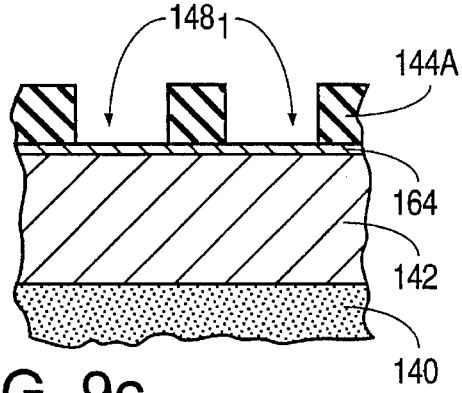

Cap layer 150, again consisting of cap regions 150A and further cap region 150B, is deposited on the upper surface of the structure as depicted in FIG. 9*e*. Track portion 144A and overlying cap portion 150B are removed in the manner described above. If adhesion layer 164A is attacked by the etchant utilized in removing track layer 144A, layer 164A is removed during the etch. If not, a separate etch is subsequently performed to remove layer 164A. In either case, FIG. 9*f* shows the resultant structure.

Figure 9F:
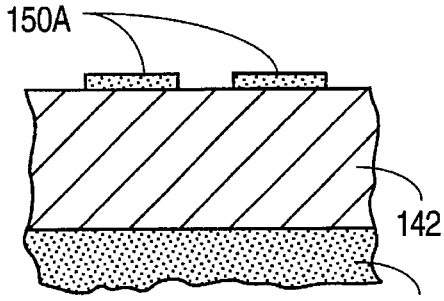

The structure of FIG. 9*f* is substantially the same as the structure of FIG. 1*e*. Accordingly, the structure of FIG. 9*f* can be processed in the manner described above to produce either the un-gated area field emitter of FIG. 1*h* or the gated area field emitter of FIG. 5*d*.

The field emitters of the invention operate in the following way. An anode (or collector) structure is situated a short distance away from the top of each area field emitter. In the ungated field emitter of FIG. 1*h*, a voltage is applied between a selected part of the anode (patterned here) and a selected one of the lines forming emitter layer 142C. Electron-emissive elements 142D above the selected emitter line then emit electrons collected at the anode structure. In the gated field emitter of FIG. 5*d*, the anode is maintained at a high positive voltage relative to emitter region 142C. When a suitable voltage is applied between (a) a selected one of the emitter lines that form region 142C and (b) a selected one of the lines that form gate layer 158B, the selected gate line extracts electrons from electron-emissive elements 142D at the intersection of the two selected lines and controls the magnitude of the resulting electron current. The extracted electrons are again collected at the anode.

Directional terms such as "top" and "upper" have been employed in describing the present invention to establish a frame of reference by which the reader can more easily understand how the various parts of the invention fit together. In actual practice, the components of a field emitter may be situated at orientations different from that implied by the directional terms used here. The same applies to the way in which the fabrication steps are performed in the invention. In as much as directional terms are used here for convenience to facilitate the description, the invention encompasses implementations in which the orientations differ from those strictly covered by the directional terms used here.

While the invention has been described with reference to particular embodiments, this is solely for the purpose of illustration and is not to be construed as limiting the scope of the invention claimed below. For example, substrate 140 could be deleted if emitter layer 142 is a continuous layer of sufficient thickness to support the structure. Substrate 140 could be replaced with a composite substrate in which a thin electrically insulating layer overlies a relatively thick electrically non-insulating layer that furnishes the necessary structural support. Structure 140 and/or emitter layer 142 could be formed under track layer 144 after charged-particle tracks 146 are formed through it.

Instead of etching emitter layer 142 with an etchant that underetches cap regions 150A, layer 142 could be etched substantially straight down with a suitable anisotropic etchant. In this case, generally cylindrical electron-emissive elements would be defined along the upper surface of the remainder of emitter layer 142. The upper ends of the cylindrical electron-emissive elements could be sharpened if desired.

For the ungated field emitter of FIG. 1*h*, sharp-tipped emitter cones could be directly formed by appropriately extending the emitter etch until cap regions 150A are removed. Formation of compound layer 154 would then be deleted. For the gated field emitter of FIG. 5*d*, insulating layer 156 and gate layer 158 could be formed along the upper structural surface at the stage shown in FIG. 1*f*. Formation of layer 154 would again be deleted. With layers 156 and 158 in place, a further emitter etch could be performed to sharpen emitter portions 142B into true cones. During the further emitter etch, cap regions 150A and overlying portions 156A and 158A would be removed to produce the gated structure of FIG. 5*c*.

Emitter layer 142 could be provided as a lower electrically conductive sublayer and an upper electrically resistive sublayer. The conductive sublayer would be formed with one or more of the electrical conductors described above for layer 142. The resistive sublayer would typically consist of cermet or lightly doped polycrystalline silicon.

Cap regions 150A could be formed over portions of adhesion layer 164. In the gated field emitter of FIG. 5*d*, gate layer 158B could be used to modulate the movement of electrons extracted from electron-emissive elements 42 by the anode. Various modifications and applications may thus be made by those skilled in the art without departing from the true scope and spirit of the invention as defined in the appended claims.

We claim:

1. A method comprising the steps of:

causing charged particles to pass through a track layer situated over an electrically non-insulating emitter layer to create a multiplicity of charged-particle tracks through the track layer;

etching the track layer along the tracks to form corresponding apertures through the track layer;

using the apertures to define corresponding cap regions over the emitter layer;

removing the track layer; and removing (a) selected material of the emitter layer using the cap regions as masks to control the removal of the selected material such that corresponding electron-emissive elements are defined in the remainder of the emitter layer at locations respectively centered on the cap regions and (b) the cap regions.

2. A method as in claim 1 wherein the using step comprises forming the cap regions in the apertures.

3. A method as in claim 1 wherein the using and first-mentioned removing steps comprise:

depositing a cap layer over the track layer and into the apertures; and removing the track layer and overlying material of the cap layer.

4. A method as in claim 1 wherein the emitter layer consists substantially of electrically conductive material.

5. A method as in claim 1 further including the step of furnishing a patterned electrically non-insulating gate layer over, and spaced apart from, the emitter layer such that a like multiplicity of gate openings extend through the gate layer at locations respectively centered on the electron-emissive elements.

6. A method as in claim 5 wherein the emitter and gate layers consist substantially of electrically conductive material.

7. A method comprising the steps of:

causing charged particles to pass through a track layer situated over an electrically non-insulating emitter layer to create a multiplicity of charged-particle tracks through the track layer;

etching the track layer along the tracks to form corresponding apertures through the track layer;

providing corresponding cap regions in the apertures over the emitter layer;

removing the track layer; and removing (a) selected material of the emitter layer, including part of the material under the cap regions, such that the remainder of the emitter layer comprises a like multiplicity of generally conical portions respectively situated below the cap regions and pointing towards them and (b) the cap regions.

8. A method as in claim 7 wherein the providing and first-mentioned removing steps comprise:

depositing a cap layer over the track layer and into the apertures; and removing the track layer and overlying material of the cap layer.

9. A method as in claim 7 wherein the second-mentioned removing step entails:

removing (a) material of the emitter layer not covered by the cap regions and (b) adjoining material of the emitter layer extending partway under the cap regions;

reacting material of the emitter layer along its exposed surface area with further matter to form a compound layer extending along the remainder of the emitter layer and below the cap regions such that the conical portions are defined in the remainder of the emitter layer; and removing the cap regions and underlying portions of the compound layer.

10. A method as in claim 9 wherein the reacting step comprises an oxidation, and the further matter comprises an oxygen-containing gas, whereby the compound layer comprises an oxide.

11. A method as in claim 7 wherein the providing step comprises electrochemically depositing the cap regions.

12. A method as in claim 7 wherein the conical portions are electron-emissive elements.

13. A method as in claim 12 wherein the conical portions are operable in field-emission mode.

14. A method as in claim 7 wherein the emitter layer comprises at least one of metal and conductively doped semiconductor material.

15. A method as in claim 14 wherein the cap regions comprise metal.

16. A method as in claim 14 wherein the track layer comprises electrically insulating material.

17. A method as in claim 7 wherein, during the causing step, an adhesion layer lies between the track and emitter layers.

18. A method as in claim 17 further including, between the providing and second-mentioned removing steps, the step of removing material of the adhesion layer situated generally to the sides of the cap regions.

19. A method as in claim 7 further including the step of furnishing a patterned electrically non-insulating gate layer over, and spaced apart from, the emitter layer such that a like multiplicity of gate openings extend through the gate layer at locations respectively centered on the conical portions.

20. A method as in claim 19 further including the step of creating a patterned electrically insulating layer between the emitter and gate layers such that a like multiplicity of dielectric openings extend through the insulating layer at locations respectively centered on the conical portions.

21. A method as in claim 19 wherein the furnishing step comprises:

depositing gate material over the cap regions and over the material of the emitter layer situated generally to the sides of the cap regions; and removing the gate material over the cap regions, whereby the remaining gate material forms at least part of the gate layer.

22. A method as in claim 21 further including the step of creating a patterned electrically insulating layer between the emitter and gate layers by a procedure that comprises:

furnishing, prior to the depositing step, electrically insulating material over the cap regions and over material of the emitter layer situated generally to the sides of the cap regions such that, after the depositing step, the gate material overlies the insulating material; and subsequently removing the insulating material over the cap regions, whereby the remaining insulating material forms at least part of the insulating layer.

23. A method as in claim 22 wherein the cap regions, the insulating material over the cap regions, and the gate material lying over the insulating material over the cap regions are all removed in a single operation.

24. A method as in claim 19 wherein the conical portions are electron-emissive elements operable in field-emission mode.

* * * * *